US005641249A

United States Patent [19]

McClelland

[11] Patent Number: 5,641,249

[45] Date of Patent: Jun. 24, 1997

[54] AGGREGATE EXTRUDER

[75] Inventor: Thomas Morris McClelland, Longwood, Fla.

[73] Assignee: Hubbard Construction Company, Winter Park, Fla.

[21] Appl. No.: 390,119

[22] Filed: Feb. 17, 1995

[51] Int. Cl.[6] ..... E02B 5/02

[52] U.S. Cl. ..... 405/268; 404/82; 404/96; 404/110

[58] Field of Search ..... 404/81, 82, 96, 404/104, 105, 106; 405/268, 50, 179

[56] References Cited

U.S. PATENT DOCUMENTS

| | | | |
|---|---|---|---|
| 2,832,273 | 4/1958 | Calabrese | 404/106 |
| 2,874,620 | 2/1959 | Mentes | 404/110 |
| 3,058,404 | 10/1962 | Widelo | 404/108 |
| 3,108,517 | 10/1963 | Fingland | 404/110 |
| 3,109,352 | 11/1963 | Mack | 404/110 |
| 3,429,130 | 2/1969 | Feiner et al. | 404/105 X |
| 4,028,902 | 6/1977 | Courson et al. | 405/179 X |
| 4,066,723 | 1/1978 | King et al. | 404/82 X |
| 4,287,141 | 9/1981 | Russell | 264/33 |
| 4,319,859 | 3/1982 | Wise | 405/268 |
| 4,360,293 | 11/1982 | Wade | 405/268 |
| 4,411,554 | 10/1983 | Gratzfeld | 404/110 |
| 4,508,471 | 4/1985 | Mulders et al. | 405/109 |
| 4,657,431 | 4/1987 | Morrison | 404/108 |
| 5,046,888 | 9/1991 | King | 404/75 |
| 5,080,532 | 1/1992 | Merville et al. | 405/268 |

*Primary Examiner*—James A. Lisehora

*Attorney, Agent, or Firm*—Maguire, Voorhis & Wells, P.A.; Robert L. Wolter

[57] ABSTRACT

This invention is an aggregate extruder for the deposition of a multi-layered aggregate bed having layers of differing aggregate material. The extruder is divided into three sections transversely disposed over a defined surface, each of the sections contains a different aggregate material. A front grading baffle is mounted behind a front panel extending intermediate side panels forming the front dispensing section. A second grading baffle is mounted between the first and rear grading baffles forming the middle dispensing section, behind the front dispensing section, and a rear dispensing section. The extruder is self-propelled by a hydraulically operated ram mounted to each side panel. A panel is mounted to the rear of each side panel of the hopper and extends rearward thereof to define channel within which aggregate is maintained as the hopper moves along the surface. When the ram is activated it extends rearward for engagement with a form, and pushes the extruder along the defined surface. The aggregate material from each dispensing section is deposited on the ground. Each grading baffle grades the layer of aggregate deposited immediately forward the grading baffle to a preselected level.

21 Claims, 5 Drawing Sheets

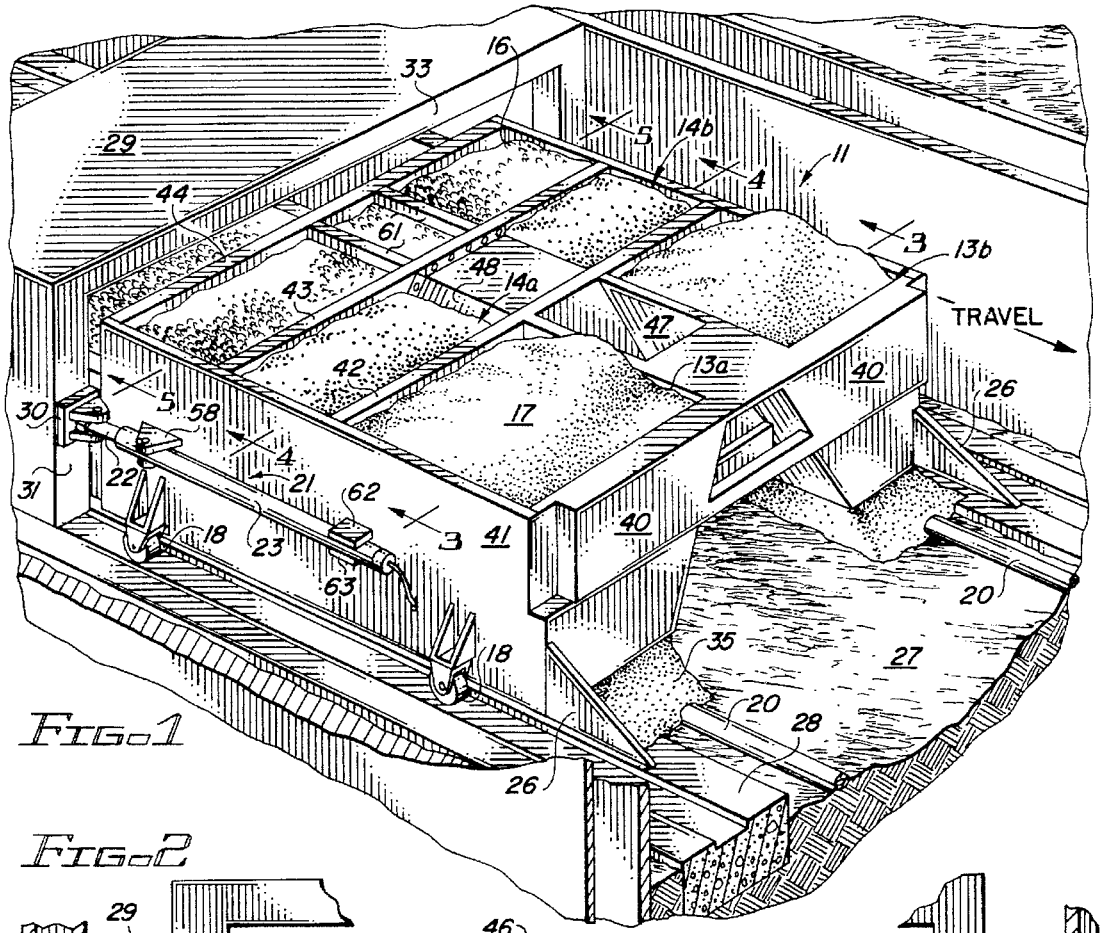
FIG. 1
FIG. 2
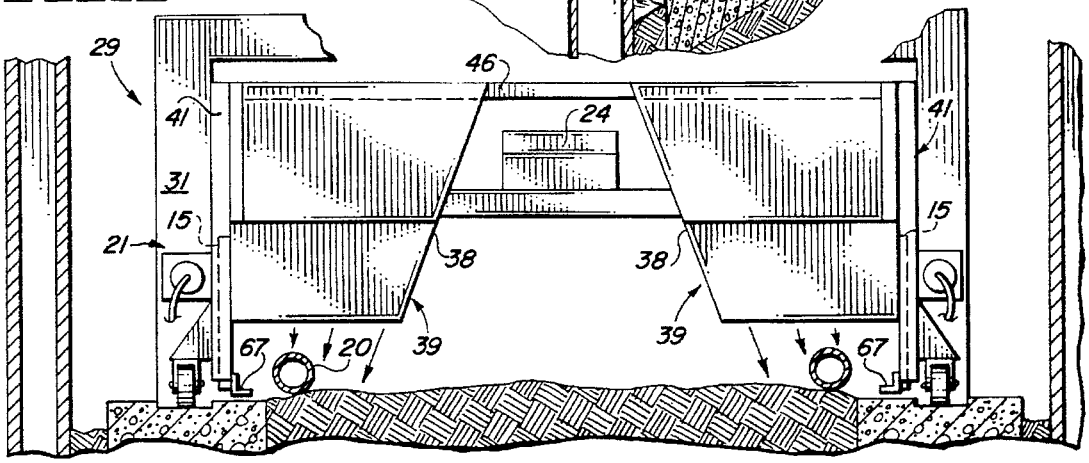
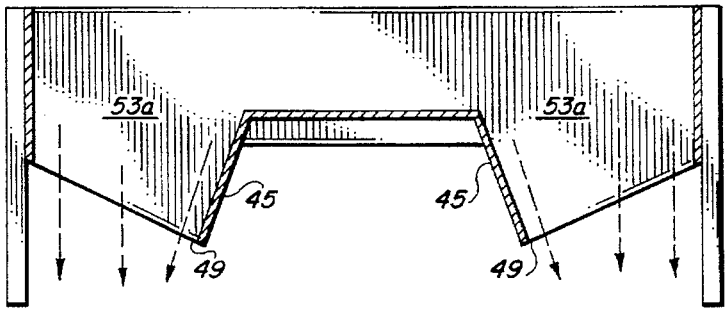
FIG. 3

FILL

TRAVEL
ROD PUSHES

ROD RETRACTS

FORM IN

TRAVEL
PISTON PUSHES

PISTON RETRACTS

FORM IN

TRAVEL
ROD PUSH

FIG. 10
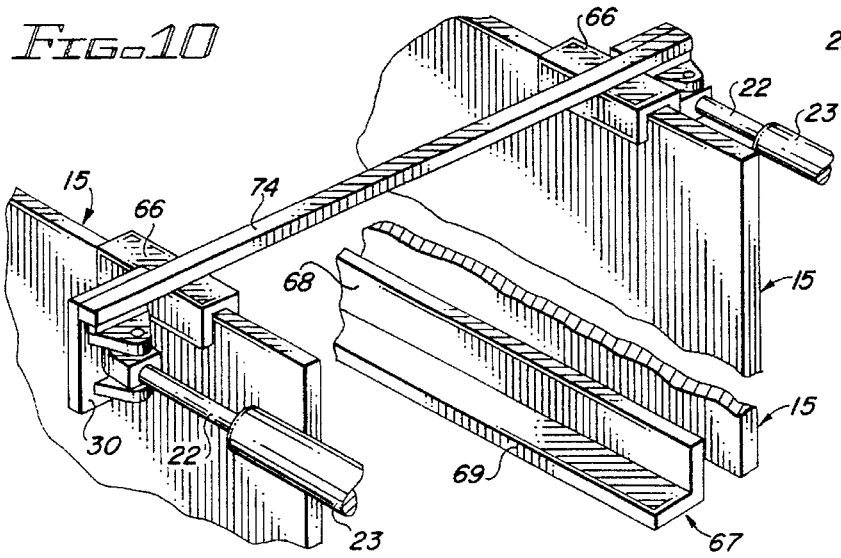
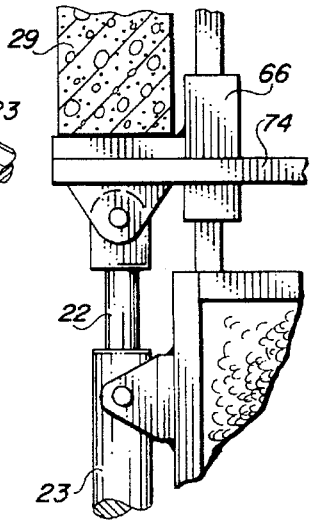
FIG. 11
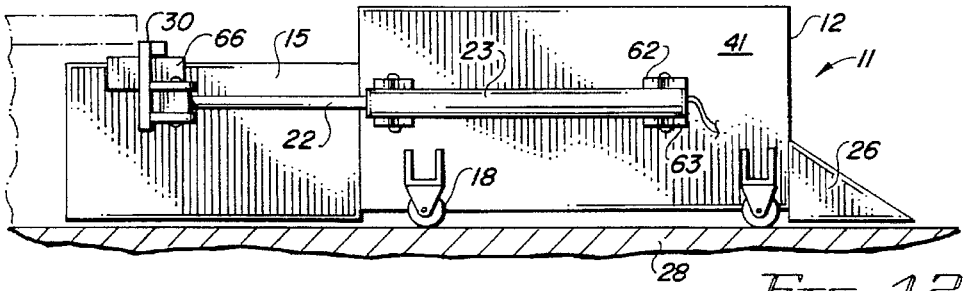
FIG. 12
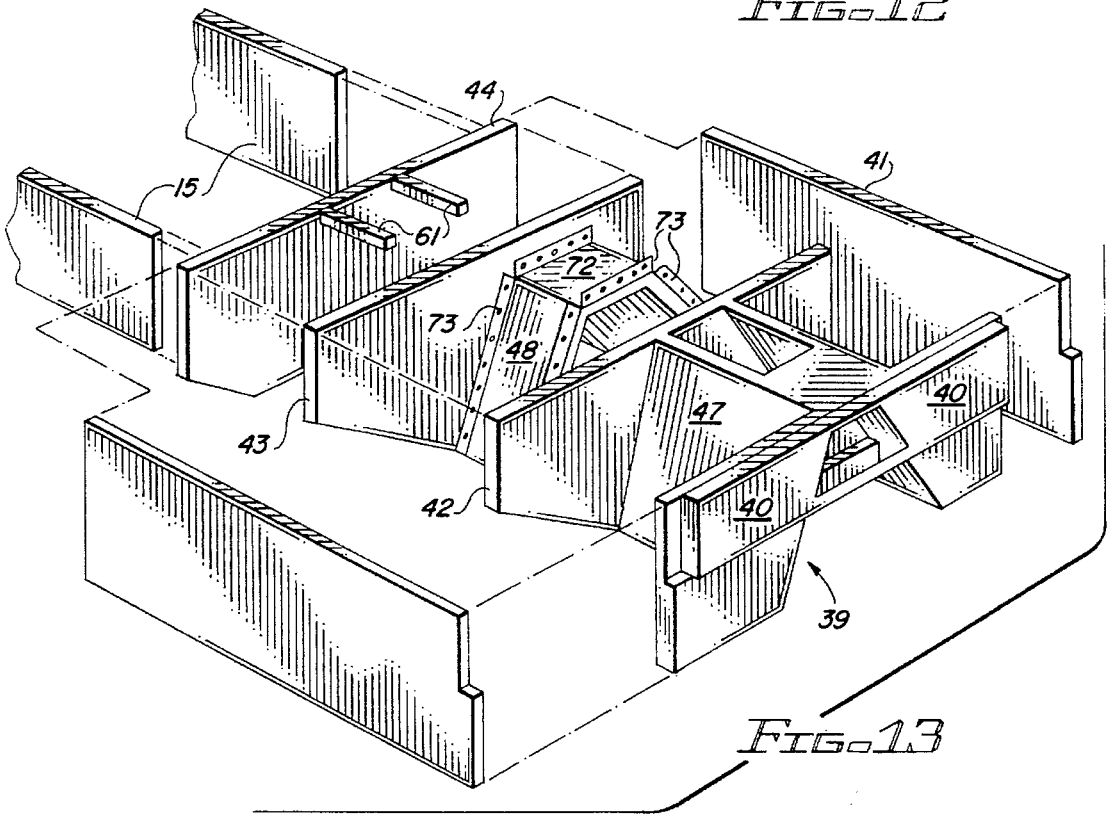
FIG. 13

AGGREGATE EXTRUDER

FIELD OF THE INVENTION

This invention relates generally to an apparatus used in construction of drainage ditches or canals. More specifically, this invention relates to self-propelled equipment used in laying a filtration bed for a drainage ditch or canal.

BACKGROUND OF THE INVENTION

When rain water is collected, it is usually directed to small lakes or retention ponds that may serve as water supplies or recreational cites for a local populous. Before the water empties into the lakes or ponds, it undergoes a filtration process. Water is usually collected in canals or ditches where in a filtration system separates and removes larger debris from the water. The bottom of the canal or ditch is lined with a multi-layered filtration bed. As the water drains into the ditch, it seeps through the bed and collects in a conduit system which directs the water to a second filtration phase.

A drainage bed may consist of a sand aggregate bottom layer, and consecutive stone layers of differing gradations on top of the sand bed. Deposition of such a multi-layered filtration bed usually requires depositing one layer at a time. Each layer is first deposited in the canal ditch then graded to a desired level. After grading to a desired level, another aggregate layer of a different gradation is placed on top of the first and also graded to a desired level.

It is an objective of the present invention to provide an aggregate extruder that simultaneously deposits multiple layers of different aggregates as it moves along a desire path. Still another object of this invention is to provide the extruder with a grading means that grades each layer as it is deposited. Yet another object of this invention is to provide such an aggregate extruder with self-propulsion means.

These and other objectives are achieved by utilizing a self-propelled extruder for simultaneously depositing and grading multiple sections of a drainage/filtration bed. The extruder includes a hopper divided into dispenser sections. Each section of the hopper is filled with appropriate aggregate material to be deposited to form the bed. A grading blade is mounted toward the rear of each dispenser section for grading the layer of aggregate deposited. A panel extends horizontally from each side of the rear of the extruder to maintain the width of the bed in that area behind the extruder. Wheels are mounted to the hopper to facilitate movement along a desired path.

A hydraulic system including a cylinder and rod extension is mounted on each side of the hopper. When the hydraulic system is activated, the arm extends from the cylinder and pushes against a fixed abutment forcing the hopper along the ditch opposite the extension of the hydraulic arm. As the hopper moves along the ditch or desired path, it deposits aggregate from each section of the hopper. The grading blade at the rear of each section grades the aggregate material deposited immediately forward the blade. An adjacent dispenser section is behind a forward section simultaneously deposits a layer of aggregate on top of the aggregate layer before it.

BRIEF DESCRIPTION OF THE DRAWINGS

FIG. 1 is a perspective view of the aggregate extruder.

FIG. 2 is a front elevational view.

FIG. 3 is a front elevational view of the first grading baffle.

FIGS. 8(*a*) through 8(*g*) are drawings illustrating movement of the aggregate extruder along a canal or ditch.

FIG. 10 is an expanded perspective view of the guide means for the hydraulic rams.

FIG. 11 is a top view of the guide means.

FIG. 12 is a side view of the extruder.

FIG. 13 is an expanded perspective view of the dispenser means.

DETAILED DESCRIPTION OF THE INVENTION

Figure 4:
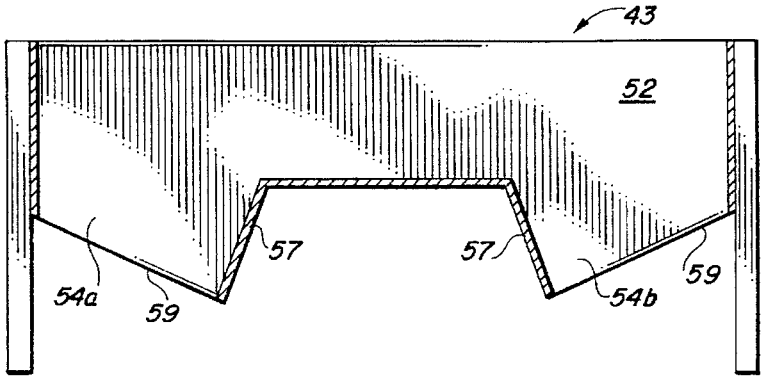
FIG. 4 is a front elevational view of the second grading baffle.
Figure 5:
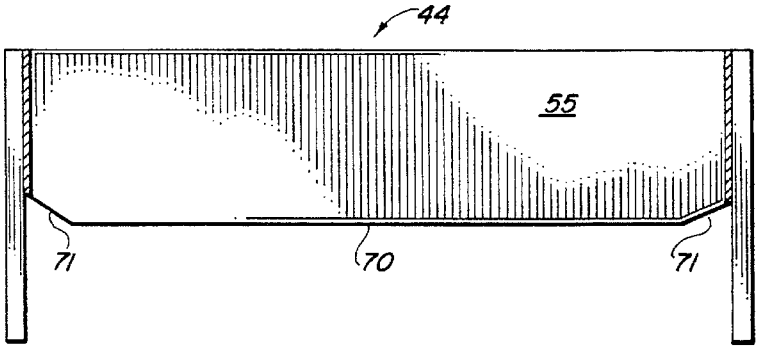
FIG. 5 is a front elevational view of the third grading baffle.

The aggregate extruder 11 described in this specification is generally shown in FIG. 1 and is basically a large hopper, or dispensing means, adapted to deposit a multi-layered filtration bed of differing aggregate materials in a drainage canal, or on any defined surface adapted to retain the aggregate bed. The hopper 12 is divided into three dispensing sections 13, 14 and 16. Each section is filled with an aggregate material 17.

The hopper 12 includes a front panel 39, and two side panels 41 substantially perpendicular the front panel 39, and extending rearward to a rear grading baffle 44 forming the outer frame of the hopper 12. Each dispensing section 13, 14, and 16 has an open bottom so the aggregate material 17 filling the hopper 12 falls directly to the bottom of the ditch or canal 27 or defined surface.

A first grading baffle 42 is mounted behind the front panel 39, parallel therewith, and perpendicular the side panels 41, extending the width of the hopper 12. A second grading baffle 43 is mounted intermediate, and parallel, the first 42 and third 44 grading baffles as shown in FIG. 1, dividing the hopper 12 into the dispensing sections 13, 14, and 16, referred to above. Each of these grading baffles is adapted to grade a respective layer of aggregate material 17 (including layers 35, 36 and 37 shown in FIG. 9) deposited from the dispensing section immediately forward the grading baffle as the hopper moves along a desired path.

A panel 15 is mounted flush to the rear of each side 41, and extends rearward of the hopper 12 about a quarter of an inch above the top of the footer 28. Each panel is about twelve feet long and four feet in height. The panels 15 are parallel one another and form a channel within which aggregate is retained, providing vertical support to the aggregate bed as it is left at the bottom of the ditch 27 as the extruder moves along the ditch. A right angle member 67 is mounted to the base of each panel having a vertical section 68 welded to the panel 15 and a horizontal section 69 extending inward adjacent the top of the footer 28, as shown in FIGS. 2 and 10.

The entire extruder device is composed of steel component parts and may weigh as much as eleven tons. From bottom to top, the extruder is almost eight feet tall (7'11"), and each side panel 41 is sixteen feet, eight inches. Since the extruder is so large and may hold such a large amount of aggregate, the dimensions of the extruder may be modified to facilitate the movement of the extruder and consequently the deposition of the aggregate material.

The entire width of the extruder from the front panel 39 to the end of the panels 15 slightly tapers outward about six inches. Specifically, at the front panel 39 the inside dimension is about eighteen feet, two inches wide. The rear baffle is about eighteen feet and four inches wide. At the front of the panels 15 adjacent the side panel the inside dimension is eighteen feet, four inches The distance between the panels 15 is defined by the inside width of form 29. This gradual outward taper allows the aggregate to more freely fall from the extruder as it moves along the ditch and deposits aggregate.

The extruder is also equipped with a self propulsion means that facilitates incremental movement of the extruder along a desired path. A hydraulic ram 21 consisting of rod 22 and cylinder 23 is mounted towards the rear on each side of the hopper 12. An engagement foot 30 is mounted to the end of the rod 22 for contact with the form 29. The ram 21 is in fluid connection with a hydraulic motor 24 which is powered by a generator. As will be explained in more detail below, the rod 22 of the hydraulic ram 21, when activated, extends rearward of the hopper 12 and into engagement with a fixed abutment to force the extruder 11 along a desired path. Wheels 18 mounted toward the base enable the extruder 11 to move along a desired path.

The hydraulic ram means is attached toward the rear of each side panel. As shown in FIGS. 1, 11 and 12, a bracket and head trunnion 64 provide a fixed mount for the ram means, so the piston extends at a height just below the top edge of the panels 15. The cylinder 23 extends forward adjacent side 41. The cap end 61 of the hydraulic ram 21 extends between upper 62 and lower 63 support members mounted to the sides 41. As rod 22 extends and engages form 29, the cylinder 23 is able to slightly pivot at the bracket 64. The support member 62 and 63 are provided to maintain a vertical alignment of cylinder 23 as the rod 22 extends and engages form 29.

Additionally, a guide means is mounted directly to the engagement foot 30 on rod 22. This guide means is an inverted channel member 66 welded to the engagement pad 30 so the channel member 66 fits over the top edge of the panel 15. As the rod 22 and engagement foot 30 are extended and retracted, the channel member 66, in conjunction with the steel tube 74, maintains the vertical alignment of the piston and engagement foot 30 preventing excessive side loading. Accordingly, engagement of channel member 66 with the panel 15 maintains the proper vertical position of the rod 22 so it is effectively retracted into cylinder 23, without undo side loading, when ever the engagement foot 30 is not in contact with form 29. Also, as illustrated in FIGS. 3 and 13, a steel tube 74 extends intermediate, and is bolted directly to, each engagement foot 30. This arrangement counteracts any rotational movement of the rod 22 or engagement foot 30 affording proper alignment of the rod 22.

In the particular embodiment shown herein, the extruder has been placed within an excavated ditch 27 so the dispensing sections 13, 14, and 16 are transversely disposed over the floor of the ditch 27. A footer 28 extends along each side of the ditch 27 parallel its longitudinal axis. The footer 28 serves two purposes, the first of which is to serve as a track for the extruder 11. The footer 28 also serves as a support for a form 29, placed in this ditch 27 behind of the extruder. On each side of the ditch 27, towards the footer, is a drainage conduit, to direct carry water filtered from the drainage deposited by the extruder.

The form 29 shown in FIG. 1 is actually a large concrete arch that has two vertical sections 31 and 32 resting on the footer 28, and a horizontal roof 33 that covers the ditch. When ram 21 is activated, piston 22 extends rearward the extruder and against the vertical members 31 and 32 of the form 29, forcing the extruder 11 forward along the ditch 27. This type of abutment is used to form a covered drainage canal, but one skilled in the art will realize that any abutment sufficiently stable to oppose the force of ram 21 may be used. Additionally, and as explained below, the vertical members 31 and 32, of the form 29, in conjunction with panels 15, maintain side vertical support for the aggregate filtration bed after it has been is deposited in the ditch 27.

As further illustrated in FIG. 1 and FIG. 13, each of the front 13 and middle 14 sections have inclined plates 47 and 48 mounted therein dividing each of the sections into two separate dispensing sections **13*a* and 13*b*, 14*a* and 14*b* respectively. As the hopper 12 is finally assembled the rear section 16 extends the width of the hopper 12. The inclined plates 47 and 48 form two arm sections that are perpendicular the rear dispensing section 16 and extend forward thereof, parallel one another and the longitudinal axis of the ditch 27**.

As shown in FIG. 2, the front panel 39 has two face panels 40 mounted to, and depending from, a horizontal steel tube 46 and covering the end of each arm section. Each face panel 40 has an edge 38 that extends downward from the horizontal tube 46 at an angle toward the respective side 41. From each face panel 40, an inclined plate 47 extends intermediate the front panel 39 and the first grading baffle 42. Each inclined plate 47 has a planar surface that extends downward in alignment with edge 38 on the face panel 40, forming the front dispensing sections **13*a* and 13*b* of the hopper for deposition of the first (sand) layer of aggregate 35**.

The first grading baffle 42, for grading aggregate layer from sections **13*a* and 13*b*, is shown in FIG. 3. Depending on the desired grading level or elevation of the first layer of aggregate 35, the first grading baffle may adapted accordingly. The grading baffle 42 essentially consists of rectangular baffle 51 that extends intermediate the sides 41 of the hopper 12 and two triangular plates 53*a* and 53*b* integral the baffle 51. Each plate 53*a* and 53*b* is aligned with respective sections 13*a* and 13*b*** and extend the width of the section.

The first grading baffle 42 has an inclined edge 45 in alignment with the first inclined plate 47 and edge 38 of panel 39. This inclined edge 45 terminates and turns upward extending as a grading edge 49 to the side panel 41. As stated above the form of each baffle depends on the grading level design of the aggregate layer to be deposited. The bottom of the side panel extends about one quarter of an inch above the footer. The point of intersection of edge 45 and 49 in one embodiment is approximately 1 foot 8 inches above the bottom of the side panel 41, and inclined edge 49 meets side panel at a point about four feet one inch above the bottom of the side panel 41 to grade a substantially triangular first aggregate layer 35.

Figure 6:
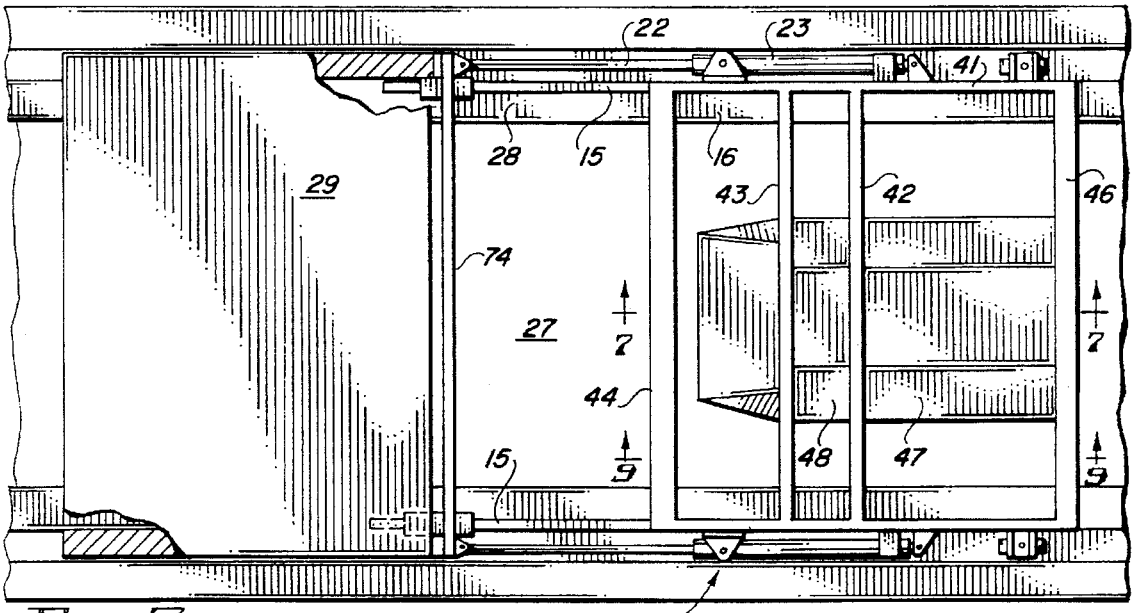
FIG. 6 is a top view of the aggregate extruder.

A second pair of inclined plates 48 is mounted in the middle section 14 and extend toward the rear dispenser section 16 intermediate the first 42 and second 43 grading baffle as shown in FIGS. 6 and 13. Similar to plate 47, the second plate 48 has a planar surface depending from the top of grading baffles 42 and 43 in alignment with the first plate 47, dividing this middle section 14 into the two dispenser section **14*a* and 14*b***.

The grading baffle 43, similar to the first baffle 42 comprises a rectangular panel 52 extending intermediate the side panels 41. Triangle grading blades 54*a* and 54*b* depend from the rectangular panel 52 to grade the aggregate laid from the middle dispenser sections 14*a* and 14*b*. Each grading blade 54*a* and 54*b* has a inclined edge 57 depending from panel 52, in alignment with inclined plate 48 terminating at a preselected point and extending upward as a grading edge 59 to the side panel 41. As with the first baffle, triangular grading blades 54*a* and 54*b* are adapted to a preselected height according to the preselected depth of layer 37 to be deposited. In applicant's embodiment disclosed herein the triangular blades 54*a* and 54*b* are equipped with inclined edge 59 to grade a uniform second layer 36 approximately three to four inches thick on top of the first layer 35. Inclined edge 57 joins the grading edge about one foot, eleven inches above the bottom of the ditch, and the grading edge 59 meets side panel at a point about four feet, four inches above the bottom of side panel 41.

While the front 13*a–b* and middle 14*a–b* dispenser sections width are each defined by the distance between side panels 41 and inclined plates 47 and 48, the rear section 16 extends the entire width of hopper 12, intermediate side panels 41. The rear or third grading baffle 44, similar to the other has the rectangular panel 58 extends intermediate side panels 41. A substantially planar blade 59 is mounted to bottom of the panel and grades the third aggregate 37 deposited from the rear dispenser 16. The bottom horizontal edge 70 that is about three feet, seven inches above the bottom of side panel 41, and two edges 71, at each end, that flare upward to meet side panel 41 about four feet four inches above the bottom of side panel.

Figure 7:
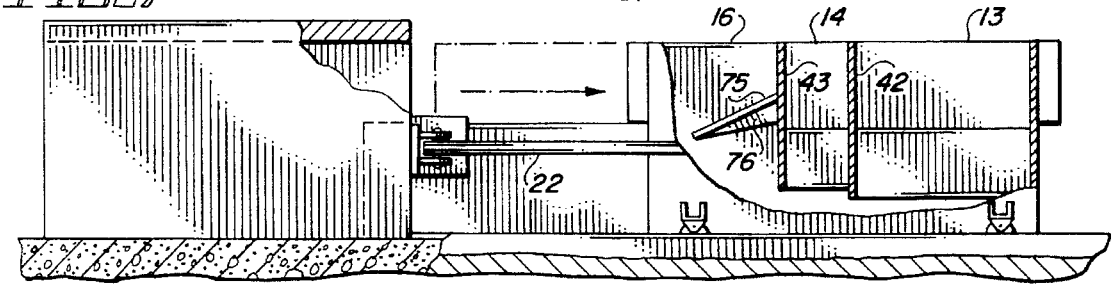
FIG. 7 is a cross-sectional view taken along line 7—7 in FIG. 6.
Figures 8A, 8B, 8C, 8D, 8E, 8F, 8G, 9:
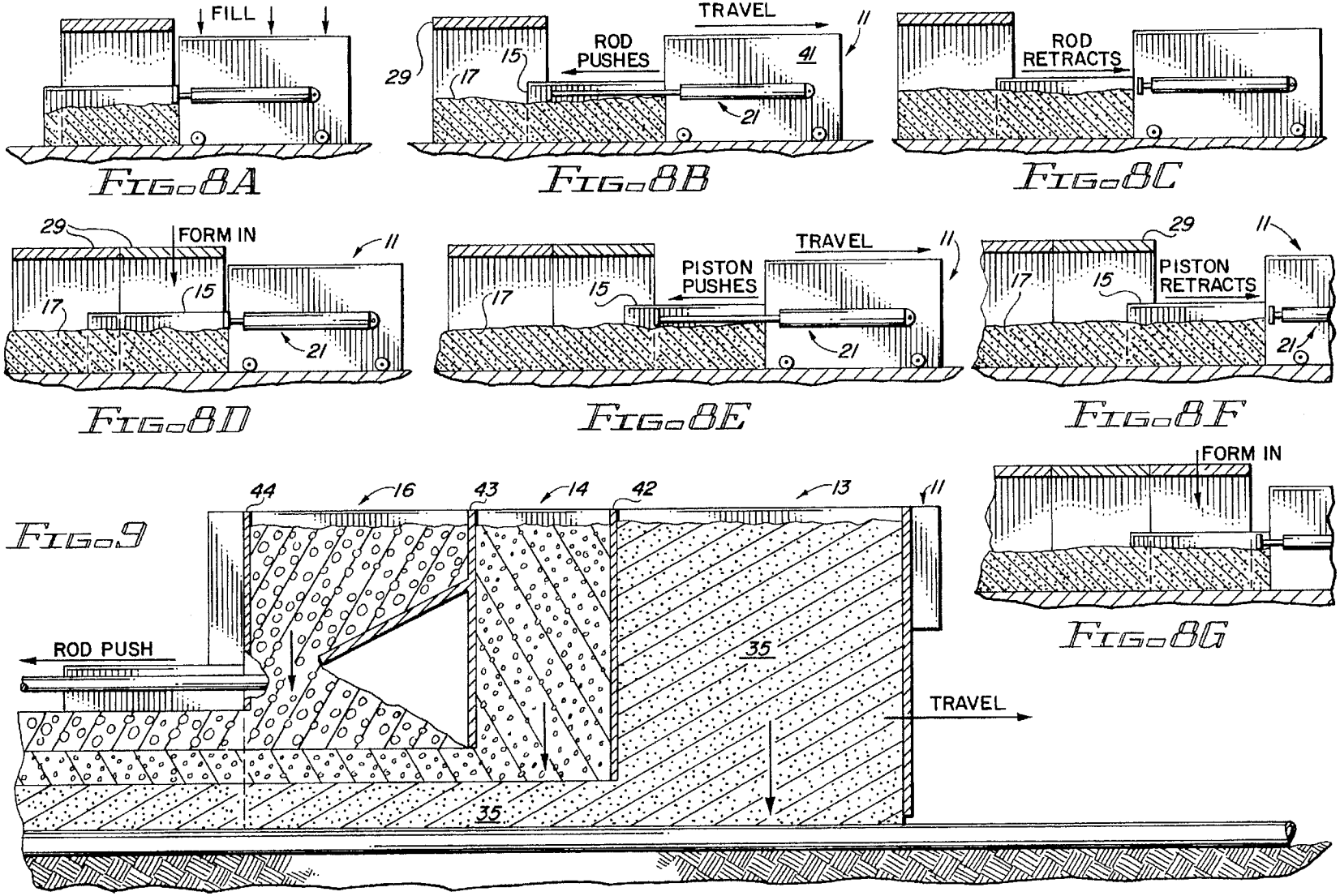
FIG. 9 is a cross-sectional view taken along 9—9 in FIG. 1.

As shown in FIGS. 6, 7 and 9 in the rear dispenser section a third inclined plate 75 is mounted to the second grading baffle 43 and extends toward the rear grading baffle 44 at an angle below horizontal. A support plate 76 mounted underneath and toward each end of the inclined plate 75. Similar to incline plates 47 and 48, the inclined plate 75 forms a substantially planar surface that narrows the opening of dispenser section 16 to control the amount of aggregate material deposited into the ditch.

As previously mentioned above, the entire extruder is made out of component steel parts. In an embodiment manufactured by the applicant, the front 13 and rear 16 dispensing sections are each made into separate units and detachably mounted together to form the middle section dispenser section 14, as shown in FIG. 13. The inclined plate 47 extending intermediate, and perpendicular, the front panel 39 and first grading baffle 42 are welded therein to form a single unit. Similarly, as shown FIG. 1, steel tubes 61 extending intermediate the second 43 and third 44 baffle means are welded thereto to form a single unit. The side panels 41 are detachably secured to hopper so the entire apparatus may be broken down into its components including the front 13 and rear 16 dispenser sections and side panels 41.

To assemble the device the front 13 and rear 16 section are placed parallel to each other and side panels 41 are mounted to these section 13 and 16 with a void existing between the sections 13 and 16. The inclined plates 48 are welded to a bridge 72. Both the bridge 72 and inclined plates 48 have flanges 73 with apertures to bolt this unit to the first 42 and second 43 grading baffles to form the middle dispenser section 14 with sections 14*a* and 14*b*.

The operation of the extruder depositing the aggregate material is shown in FIGS. 8(*a*) through 8(*g*). The separate component parts are hoisted into the ditch and the extruder is assembled therein so the wheels 18 rest on footer 28. A form 29 is placed in the ditch 27 behind the extruder. The extruder is then filled with the aggregate placing the different materials in the appropriate sections.

In FIG. 9 the material forming the bottom aggregate layer is designated 35 and placed in the front dispenser sections 13*a* and 13*b*, and may include sand. When sand 35 fills the first sections it spills forward of the extruder 11, and sand shields 26 maintain the sand aggregate from spilling onto the footer 28 in the path of the wheel. The second aggregate layer 36, to be deposited on the first aggregate layer 35, is placed in middle dispenser sections 14*a* and 15*b*, and may include a gravel aggregate Finally, tke material forming the top aggregate layer is designated 37, and is placed in the rear dispenser section, and also includes a gravel aggregate that is a larger grain than the aggregate 36. As shown in FIG. 9, since the hopper is bottomless the material rests on the floor of the ditch as it fills the hopper.

In FIG. 8(*b*), the hydraulic rams 21 are then activated to push the extruder forward to deposit the multilayer drainage bed. When the hydraulic system is activated, the rod 22 extends rearward the hopper 12. Each rod 22 engages a vertical member 31 leg of the form 29. As the rod extends, it pushes the extruder along the footer 28 in a direction opposite the extension of rod 22.

As shown in FIGS. 8(*b*) and 9 as the extruder moves along the path, it deposits the aggregate bed which includes layers 35, 36 and 37. The grading baffle 42 grades layer 35, grading baffle 43 grades layer 36 and grading baffle 43 grades the top layer 37. Note, as the extruder moves along the footers 28, the aggregate bed deposited is channelled between panels 15 to maintain the profile of drainage bed. Each plate is approximately twelve feet long and should extend rearward of the extruder beyond the length of a fully extended rod 22. Thus as shown in FIG. 8(*b*) a portion of the panel 15 remains confined by form 29 after rod 22 has extended to move the extruder.

In FIGS. 8(*c*) and 8(*d*), rod 22 retracts and another form 29 is placed on footer 28 adjacent plates 15. As shown in FIG. 8(*e*), the rod 22 is then activated again to engage the new form 29 and force the extruder forward again. In each increment of movement, the extruder deposits the multilayered bed, as shown in FIG. 9. As the extruder leaves the bed, panels 15 maintain the form of the bed until another form 29 is placed behind the extruder for further advancement along the ditch. Note that as the extruder moves the panels 15 also moves from under the forms. The vertical members 31 of forms 29 replace the panels 15 in maintaining the vertical support of the bed so it does not collapse. This side vertical support is especially crucial for laying a filtration bed where the layers consist of a different grain material and must remain separate to effect the filtration process.

Note, that as shown in FIG. 8(*g*), there is a small section of panel 15 that extends inside the form 29 with the aggregate bed 17 deposited within the panels. When the rod 22 extends against the next form 29, the panel 15 will be removed. Since each panel 15 is about one inch thick, the removal of a panel 15 causes a void that is immediately filled by settling aggregate. To compensate for this settlement factor, the rear baffle 44 has the flared edges 71. As layers 35–37 settle and the grading baffle finally grades top layer 37 to form a substantially horizontally top of aggregate bed.

Figure 14:
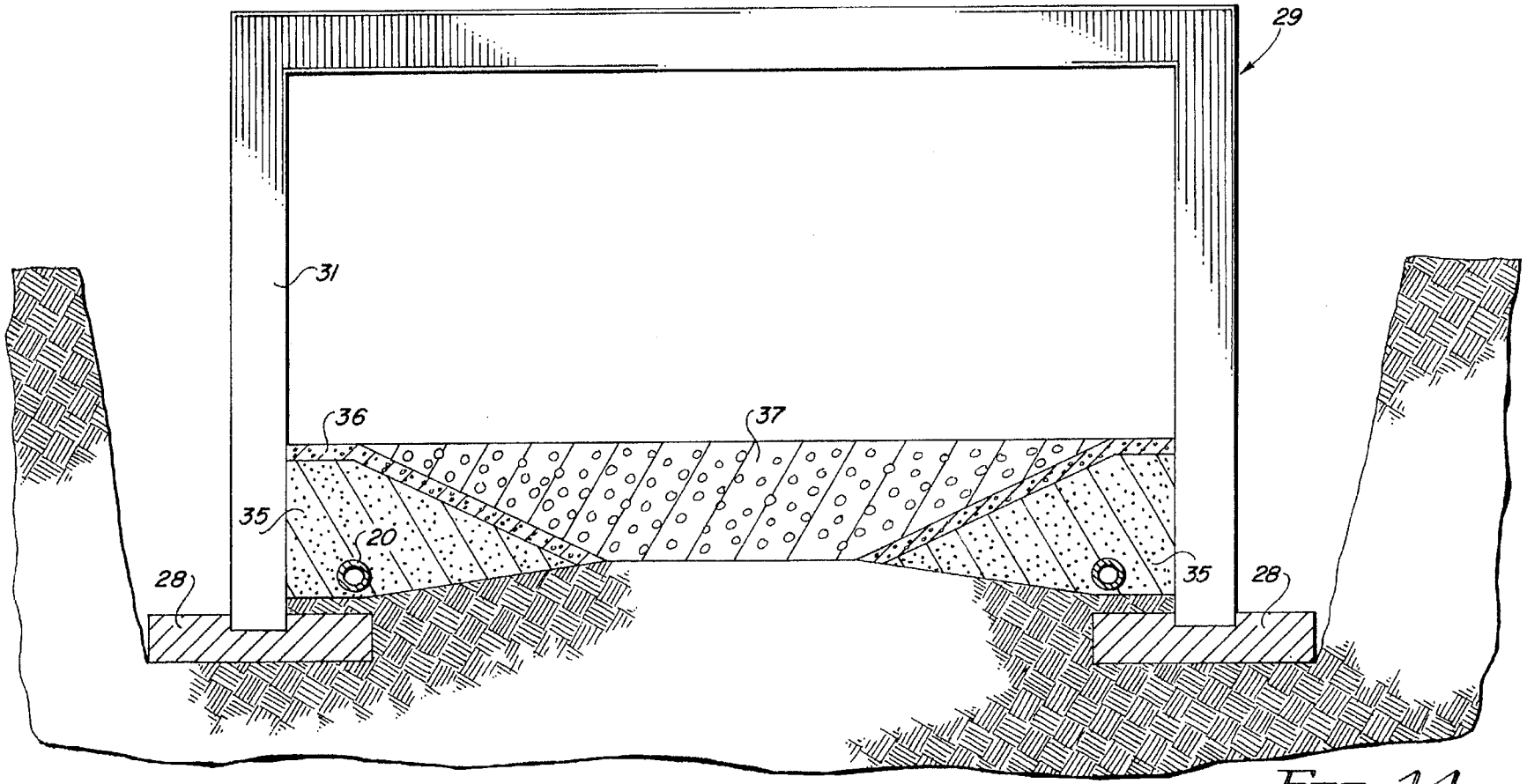
FIG. 14 is a typical sectional view of an aggregate drainage bed deposited by the extruder.

FIG. 14 illustrates a sectional view of the multi-layered filtration bed deposited by the extruder. As water collects in the drainage ditch it filters through the aggregate bed. Each layer filters out contaminants and debris as the water moves downward to the bottom of the ditch where it collects in the drainage conduit 20 and is directed to appropriate sites for further filtration.

While I have disclosed the preferred embodiment of my invention, it is not intended that this description in anyway limits the invention, but rather this invention should be limited only by a reasonable interpretation of the now recited claims.

What I claim is:

1. A self-propelled extruder for depositing a multi-layer aggregate bed over a defined surface, said extruder comprising:

(a) a dispenser frame having a first means for depositing a first layer of aggregate on said defined surface, a second means, adjacent said first deposition means, for depositing a second layer of aggregate on top of said first layer of aggregate, and a third means, adjacent said second deposition means, for depositing a third layer of aggregate on top of said second layer of aggregate;

(b) means, attached to said dispenser frame, for self propelling the dispenser frame over said defined surface, wherein said self propulsion means includes a wheel means and a ram means, mounted on said dispenser frame, for engagement with a support, for movement of the extruder along a desired path in a direction opposite the extension of said ram means; and, (c) means, attached to said dispenser frame and extending rearward thereof, for providing side vertical support for the multi-layered aggregate deposited.

2. A self-propelled extruder for depositing a multi-layer aggregate bed over a defined surface, said extruder comprising:

(a) a dispenser frame having a first means for depositing a first layer of aggregate on said defined surface, a second means, adjacent said first deposition means, for depositing a second layer of aggregate on top of said first layer of aggregate, and a third means, adjacent said second deposition means, for depositing a third layer of aggregate on top of said second layer of aggregate wherein each said deposition means includes means, mounted to said dispenser frame, for grading each said aggregate layer deposited from said extruder to predetermined level, and said third deposition means includes a rear dispenser section, transversely disposed over said defined surface, and said first and second deposition means includes a pair of parallel arm sections extending forward of said rear dispenser section, each said arm section having at least one dispenser section; and (b) means, attached to said dispenser frame for self propelling the dispenser frame over said defined surface.

3. An extruder as defined in claim 2 wherein each said arm section includes a front dispenser section, for deposition of the first aggregate layer on the defined surface, and a middle dispenser section, intermediate the rear and front dispenser sections, for deposition of a second aggregate layer on top of said first layer, said rear dispenser depositing a third aggregate layer on said second layer.

4. An extruder as defined in claim 3 wherein said self-propulsion means includes wheel means attached thereto, and a hydraulic ram means for engagement with a support for movement of the extruder along the desired path in a direction opposite the extension of said hydraulic ram means.

5. An extruder as defined in claim 4 further including means, attached to the dispenser frame and extending rearward thereof, for providing a temporary vertical side for the multilayered aggregate bed deposited from said deposition means.

6. An extruder as defined in claim 5 wherein said side vertical means includes rear panels mounted to said rear dispenser section extending rearward of said extruder.

7. A self-propelled extruder for depositing a multi-layered aggregate bed over a defined surface, said extruder comprising:

(a) a hopper divided into at least two separate dispenser sections transversely disposed over the defined surface and parallel one another; wherein said dispenser sections include a rear dispenser section transversely disposed over said defined surface and a pair of parallel arm dispenser sections connected to the rear dispenser section, perpendicular thereto and extending forward thereof parallel the longitudinal axis of said defined surface;

(b) a grading means, attached to said hopper rearward of each said dispenser section, for grading the aggregate material deposited from each said dispenser section forward of each said grading means; and, (c) a self propulsion means attached to the extruder for propelling the extruder along a desired path.

8. An extruder as defined in claim 7 wherein each said arm dispenser section includes a front dispenser section and a middle dispenser section, intermediate the rear dispenser and each said front dispenser sections.

9. An extruder as defined in claim 8 wherein said propulsion means includes a ram means for extension rearward of the hopper means for engagement with a support to push said extruder in a direction opposite the extension of said ram means.

10. A self-propelled extruder for depositing a multi-layered aggregate bed over a defined surface, said extruder comprising:

(a) a hopper divided into at least two separate dispenser sections transversely disposed over the defined surface and parallel one another;

(b) a grading means, attached to said hopper rearward of each said dispenser section, for grading the aggregate material deposited from each said dispenser section forward of each said grading means, and said dispenser means includes a front panel and a rear grading means and two side panels extending intermediate and perpendicular thereto forming an outer dispenser frame, and a first and second parallel grading means forward the rear grading means and parallel thereto, extending intermediate said side panels dividing the hopper means into three dispenser sections including a front dispenser section having said first grading means, a middle dispenser having said second grading means, and a rear dispenser section having said rear grading means;

(c) a pair of inclined plates in said front and middle dispenser sections extending substantially perpendicular said front panel in each said front and middle section, the inclined plates having a parallel top edge and a planar surface extending downward toward said defined surface and inclined toward the respective side panels of said extruder; and, (d) a self propulsion means attached to the extruder for propelling the extruder along a desired path.

11. An extruder as defined in claim 10 further including means, attached to said side panels of said extruder and extending rearward thereof, for providing vertical support for the aggregate bed deposited from said dispenser means.

12. An extruder as defined in claim 11 wherein said vertical support means includes a rear panel attached to each said side panel and extending rearward the dispenser means.

13. An extruder as defined in claim 12 wherein said self-propulsion means includes a wheel means and a ram means mounted to each side panel of said extruder for extension rearward of the dispenser means and engagement with a support forcing said extruder in a direction opposite the extension of said ram means.

14. An extruder as defined in claim 13 further including means, mounted to said ram means, for maintaining vertical alignment of said ram means.

15. An extruder as defined in claim 14 wherein said vertical alignment means includes a channel member mounted to said ram means adjacent to said rear panel and fitting over the top of said of the rear panel and a bar member extending intermediate each ram means and mounted thereto rearward of said dispenser means.

16. A self-propelled extruder for depositing a multi-layer aggregate bed over a defined surface, said extruder comprising:

(a) a dispenser means including a front panel and a rear grading means parallel each other and two side panels mounted to said front panel and rear grading means defining an outer frame of said dispenser means;

(b) a front grading means, parallel said front panel and extending intermediate said side panels, perpendicular thereto, defining a front dispenser section; and, (c) a middle grading means mounted intermediate said front and rear grading means, parallel thereto, and perpendicular the side panels defining a rear dispenser section between said rear and middle grading means, and a middle dispenser section intermediate said front and middle grading means; and, (d) a ram means mounted on each side panel for extension rearward of said rear dispenser section and for engagement with a support adjacent to the extruder to push said extruder in a direction opposite the extension of said ram means.

17. An extruder as defined in claim 16 further including a pair of inclined plates mounted in the front and middle dispenser section, dividing each said section into two separate dispensing sections, each said plate having a top edge extending perpendicular the front panel, and a planar surface extending downward toward said defined surface and inclined toward each respective side panels.

18. An extruder as defined in claim 17 wherein said rear dispenser section includes an inclined plate mounted to said second grading means and having a planar surface extend toward the third grading means below horizontal.

19. An extruder as defined in claim 18 further including means, attached to said dispenser means and extending rearward thereof, for providing side vertical support for an aggregate bed deposited from the dispenser means.

20. An extruder as defined in claim 19 further including means, mounted to said ram means for engagement with said vertical support means, for maintaining vertical alignment of said ram means.

21. An extruder as defined in claim 20 wherein said side vertical support means includes a rear panel attached to each side panel of the outer frame of the dispenser and extending rearward thereof and said alignment means includes a channel member mounted to each said ram mans for engagement with the rear panel and a bar member extending intermediate and attached to each said ram means.

* * * * *